US010258182B2

(12) United States Patent
Ball

(10) Patent No.: US 10,258,182 B2
(45) Date of Patent: Apr. 16, 2019

(54) DECORATIVE TREE ORNAMENT

(71) Applicant: Melissa Ball, Lexington, NC (US)

(72) Inventor: Melissa Ball, Lexington, NC (US)

( * ) Notice: Subject to any disclaimer, the term of this patent is extended or adjusted under 35 U.S.C. 154(b) by 0 days.

(21) Appl. No.: 15/180,873

(22) Filed: Jun. 13, 2016

(65) Prior Publication Data

US 2016/0360915 A1 Dec. 15, 2016

Related U.S. Application Data

(60) Provisional application No. 62/174,322, filed on Jun. 11, 2015.

(51) Int. Cl.

| | |
|---|---|
| ***A47G 33/08*** | (2006.01) |
| ***A47G 33/10*** | (2006.01) |
| ***F21V 33/00*** | (2006.01) |

(52) U.S. Cl.

CPC ..... *A47G 33/0809* (2013.01); *A47G 33/0818* (2013.01); *A47G 33/10* (2013.01); *A47G 2033/089* (2013.01); *A47G 2033/0827* (2013.01)

(58) Field of Classification Search

CPC . F21V 33/00; F21V 21/00; F21V 7/04; F21V 3/00; F21V 5/00; F21S 4/00

USPC .... 362/253, 249.16, 249.1, 565, 311.13, 806

See application file for complete search history.

(56) References Cited

U.S. PATENT DOCUMENTS

| | | | | |
|---|---|---|---|---|
| 2008/0160224 | A1* | 7/2008 | Nakamura | A47G 33/0818 428/7 |
| 2010/0003891 | A1* | 1/2010 | Chen | A47G 33/06 446/385 |
| 2010/0226617 | A1* | 9/2010 | Piccionelli | A47G 33/08 345/2.1 |
| 2011/0227508 | A1* | 9/2011 | Hermanson | A47G 33/0809 315/362 |
| 2012/0008313 | A1* | 1/2012 | Plumb | A47G 33/06 362/184 |
| 2014/0321130 | A1* | 10/2014 | Loomis | F21V 21/088 362/311.13 |

* cited by examiner

*Primary Examiner* — Edwyn Labaze
(74) *Attorney, Agent, or Firm* — Daniel Cole

(57) ABSTRACT

A decorative tree ornament that is positioned atop a tree and that lights up and plays music while presenting an ornamental display that is attached to a rotating platform. The rotating is driven by a motor and support by a sheath that is designed to be fitted about the top of the tree. A plurality of slits traverses through the sheath, allowing the sheath to be navigated around the branches of the tree. A microcontroller dictates the speed of the motor, audio files played from a speaker, and the brightness and color of light emitted from a light assembly of the ornamental display. The light assembly is integrated into a festive diorama that is encased in a dome enclosure; the festive diorama and the dome enclosure both being removably attached to the rotating platform. A stabilization post is further utilized to support the sheath and the rotating platform.

15 Claims, 11 Drawing Sheets

DECORATIVE TREE ORNAMENT

The current application claims a priority to the U.S. Provisional Patent application Ser. No. 62/174,322 filed on Jun. 11, 2015.

FIELD OF THE INVENTION

The present invention relates generally to an ornamental display. More specifically, the present invention is a tree topper that lights up and plays music, in addition to presenting an interchangeable ornamental display.

BACKGROUND OF THE INVENTION

Holidays and celebrations are made more festive through the use of ornamental decorations. While each ornament is different, most decorations, such as a tree topper, are stationary and can only be viewed best from a certain angle. Furthermore, traditional ornaments rely solely on aesthetic appeal and are not interactive. Some ornaments do incorporate musical elements, however, songs or musical notes are typically preprogrammed and limited in number. Another concern with traditional ornaments it that they lack modularity; the look of the ornament cannot be changed. This leads to storage concerns. As ornaments are typically not displayed year round, they must be placed in storage in the offseason. This can become quite troublesome when collecting large amounts of ornaments, especially when many individuals do not even utilize all ornaments as they try to achieve a different decorative look each year.

Therefore it is the object of the present invention to provide a decorative tree topper that has interchangeable elements, that lights up and plays music, and that presents a rotatable display. An ornamental display is mounted onto a rotating platform, wherein the rotating platform is rotatably connected to a support structure. The support structure includes a sheath that is designed to fit atop a tree and navigate around the branches of the tree. An electronics assembly powers a motor used to drive the rotating platform, and provides a microcontroller that allows the user to change parameters of a light assembly, a speaker, and the motor. Users can upload songs from a personal computing device to the microcontroller, wherein the microcontroller operates the speaker. A stabilization post is also provided to assist in upholding the support structure atop the tree, wherein the stabilization post is able to be adjusted in order to accommodate different tree heights and structures.

DETAIL DESCRIPTIONS OF THE INVENTION

All illustrations of the drawings are for the purpose of describing selected versions of the present invention and are not intended to limit the scope of the present invention.

The present invention is a decorative tree ornament that is positioned atop a tree and that lights up and plays music while presenting a rotatable display. The present invention comprises an ornament support assembly 1, an electronics assembly 2, an ornamental display 3, and a stabilization post 7. In reference to FIG. 6, the ornament support assembly 1 provides a means for attaching the present invention atop the tree, and a means for supporting and rotating the ornamental display 3. Meanwhile, the stabilization post 7 provides additional means of support for retaining the ornament support assembly 1 in a stable position atop the tree. The electronics assembly 2 provides the electronic equipment for powering and controlling lighting, music, and the rotation of the ornamental display 3.

Figure 1:
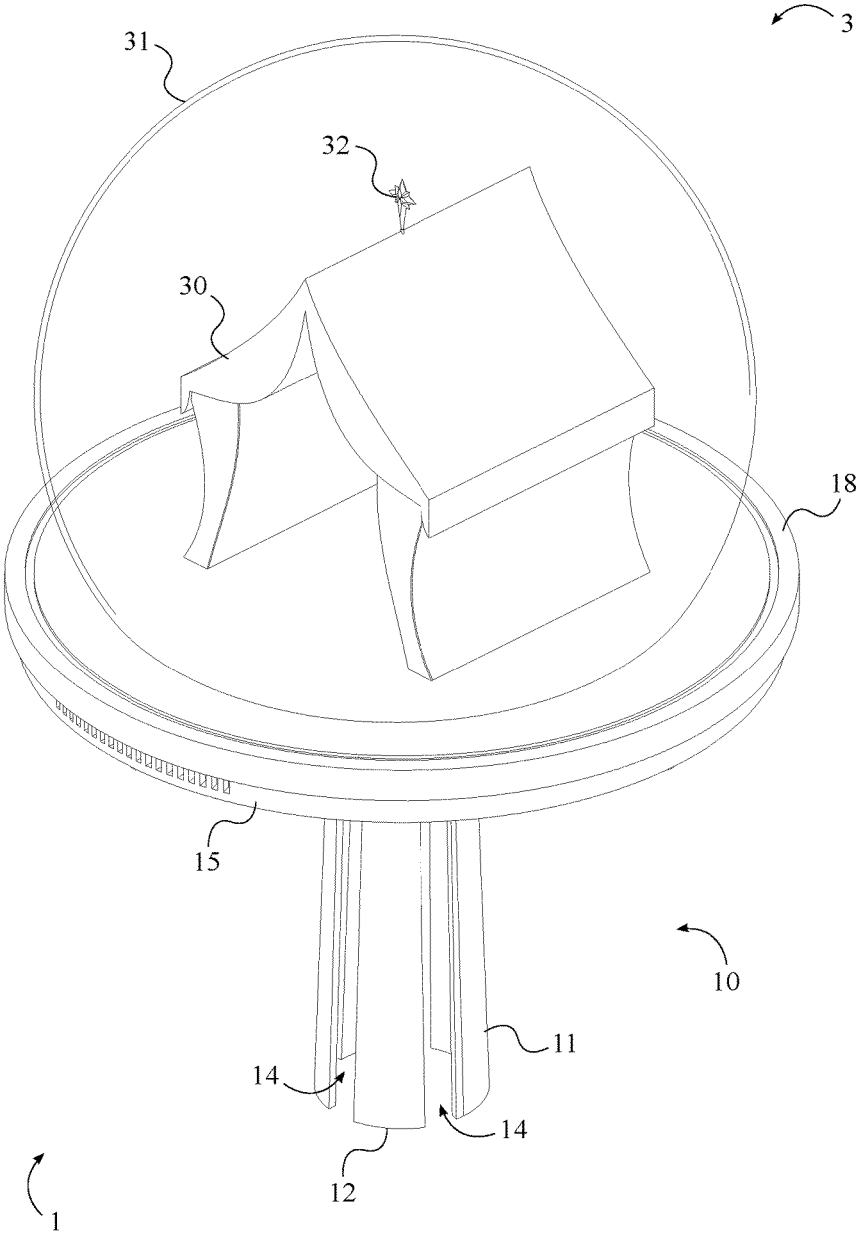
FIG. 1 is a perspective view of the present invention in the preferred embodiment.

In reference to FIG. 1, the ornament support assembly 1 comprises a support structure 10 and a rotating platform 18 that are utilized to uphold the ornamental display 3, such that the ornamental display 3 is prominently showcased atop the tree. The support structure 10 provides the means for securing the ornament support assembly 1 to the tree, while the rotating platform 18 provides a mounting surface for the ornamental display 3. The rotating platform 18 is rotatably connected to the support structure 10, wherein the support structure 10 drives the rotating platform 18 in a circular motion; the rotating platform 18 being concentrically positioned with the support structure 10.

Figure 2:
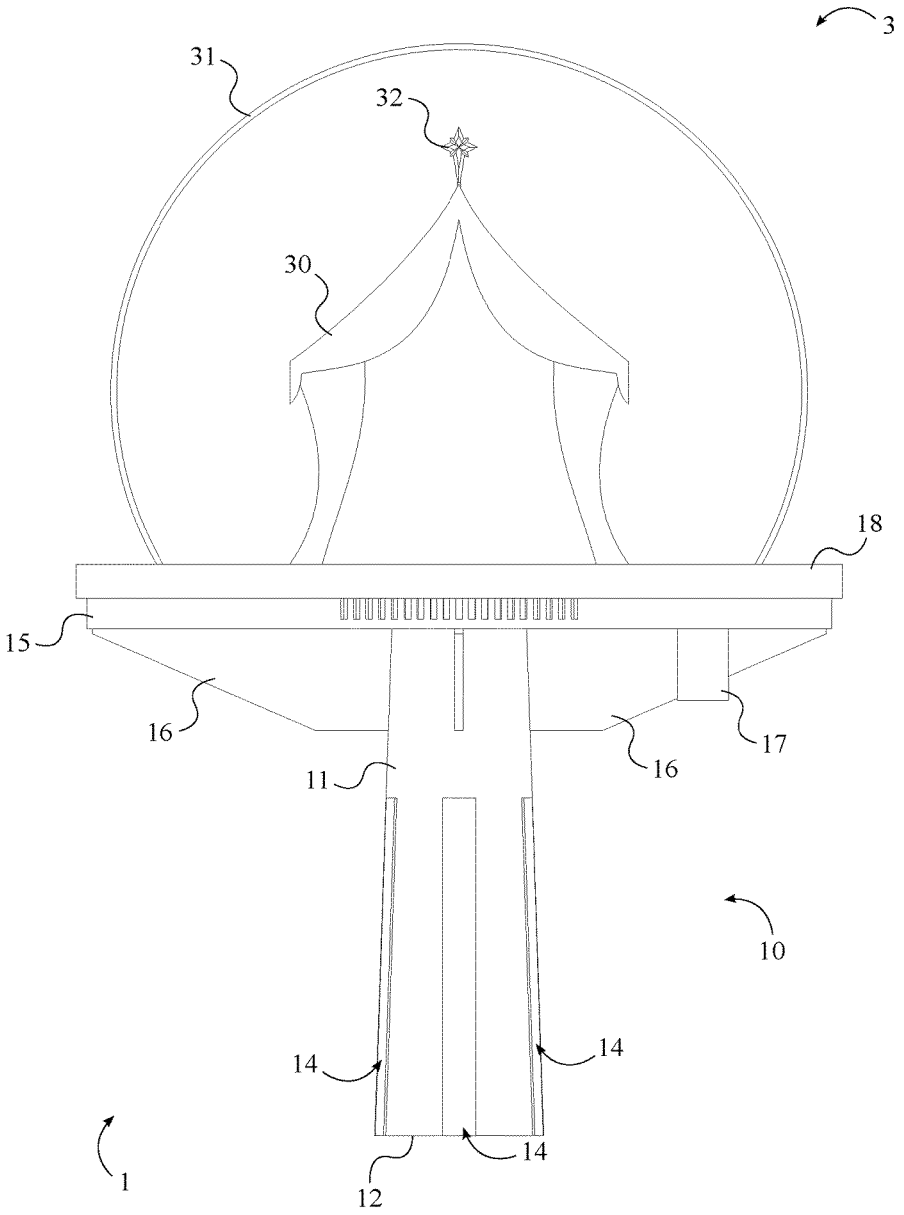
FIG. 2 is a front elevational view of the present invention in the preferred embodiment.
Figure 3:
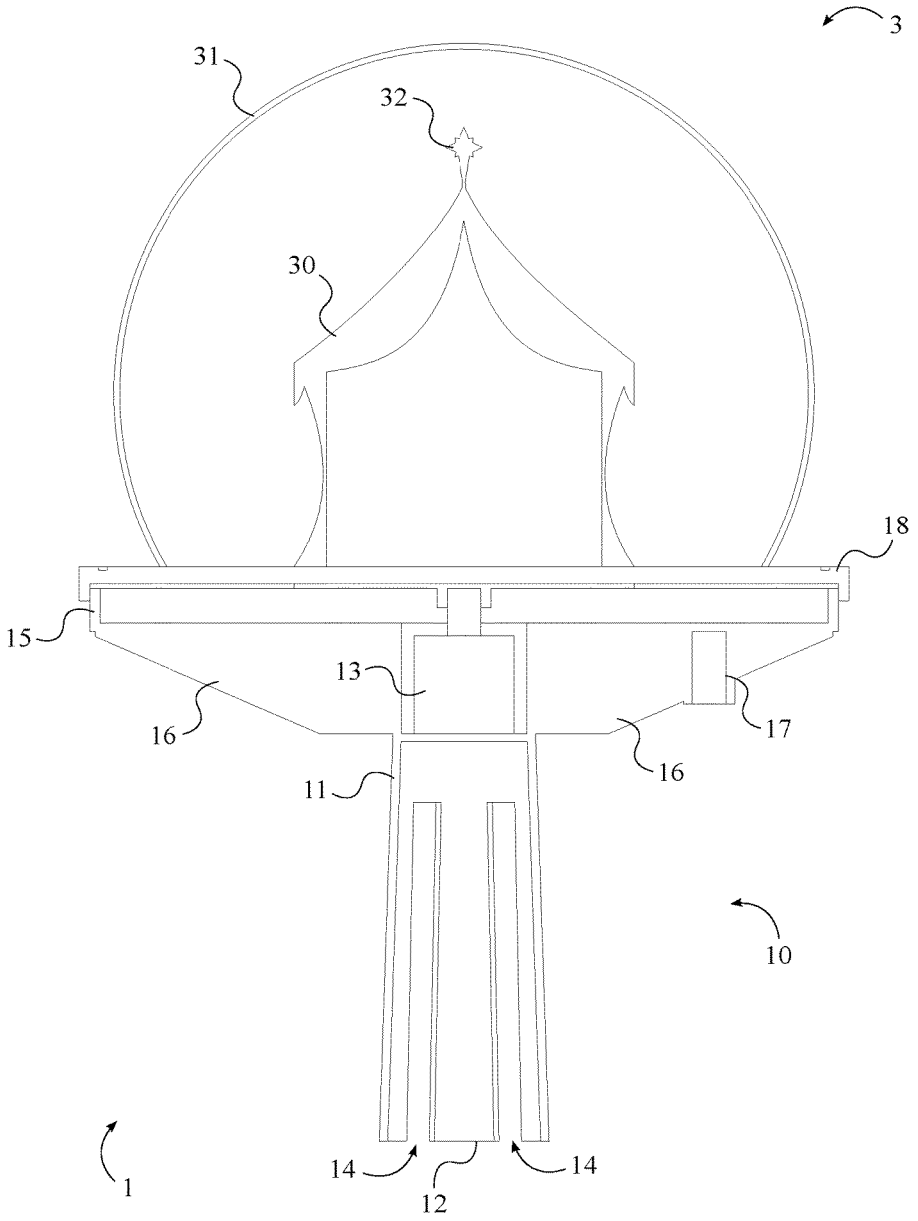
FIG. 3 is a front sectional view of the present invention, wherein the motor is concentrically mounted with the sheath.

In reference to FIG. 2-3, the support structure 10 comprises a sheath 11, a motor 13, a plurality of slits 14, a support platform 15, a plurality of braces 16, and a seat 17. The sheath 11 is a tubular length of material that is positioned over the top of the tree in order to secure the support structure 10 to the tree. Meanwhile, the motor 13 is concentrically mounted with the sheath 11 opposite a terminal edge 12 of the sheath 11; the terminal edge 12 delineating the opening of the sheath 11. The motor 13 can be positioned within the sheath 11, the support platform 15, or both. The motor 13 provides the means of rotation for driving the rotating platform 18, and as such, the rotating platform 18 is terminally connected to the motor 13 opposite the sheath 11. More specifically, the rotating platform 18 is terminally connected to a rotator shaft of the motor 13 by a rotator attachment mechanism; the rotator shaft being connected to a rotor that is rotatably coupled to a stator.

The plurality of slits 14 assists in installing the sheath 11 atop the tree. Each of the plurality of slits 14 laterally traverses through the sheath 11, providing a void along the sheath 11 that allows the sheath 11 to be navigated around tree branches. Each of the plurality of slits 14 traverses along the sheath 11 from the terminal edge 12 towards the motor 13, such that a series of openings is provided around the terminal edge 12, allowing the tree branches to be slotted within the sheath 11. In the preferred embodiment of the present invention, each of the plurality of slits 14 is a straight line, however, in other embodiments the shape of each of the plurality of slits 14 may be different, such as being zig-zagged or curved. Furthermore, the sheath 11 may be tapered towards the rotating platform 18 to account for the widening of a tree trunk and to better secure the sheath 11 to the tree.

In reference to FIG. 2, the support platform 15 is adjacently connected to the sheath 11, wherein the support platform 15 is terminally positioned about the sheath 11 opposite the terminal edge 12 and extends outwards around the sheath 11. The support platform 15 assists in stabilizing the rotating platform 18 and provides a mounting point for the seat 17, which in turn provides a connection point for the stabilization post 7. The support platform 15 is concentrically positioned with both the sheath 11 and the rotating platform 18. The rotating platform 18 is positioned above the support platform 15, wherein the rotating platform 18 comprises a perimetric lip that extends downwards, partially overlapping the support platform 15 such that the support platform 15 is positioned into the rotating platform 18.

In further reference to FIG. 2, the plurality of braces 16 provides additional structural strength to uphold the support platform 15. Each of the plurality of braces 16 is adjacently connected to both the sheath 11 and the support platform 15, wherein the plurality of braces 16 is radially positioned around the sheath 11. Each of the plurality of braces 16 extends downwards from the support platform 15 and out and away from the sheath 11. In the preferred embodiment of the present invention, the seat 17 is integrated into one of the plurality of braces 16, the seat 17 being offset from the sheath 11.

Figure 6:
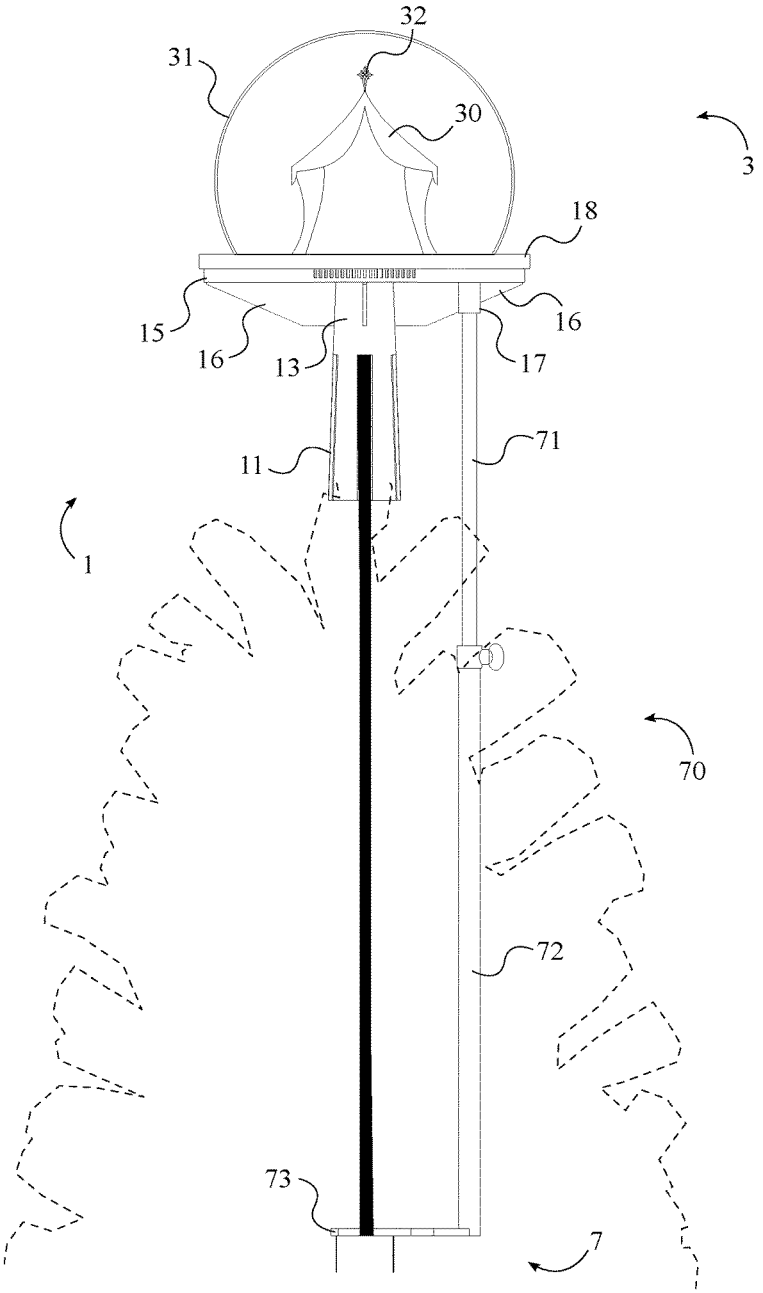
FIG. 6 is a front elevational view, wherein the sheath is positioned about the tree top support of an artificial tree and the stirrup base is positioned onto the limb support pole of the artificial tree.
Figure 11:
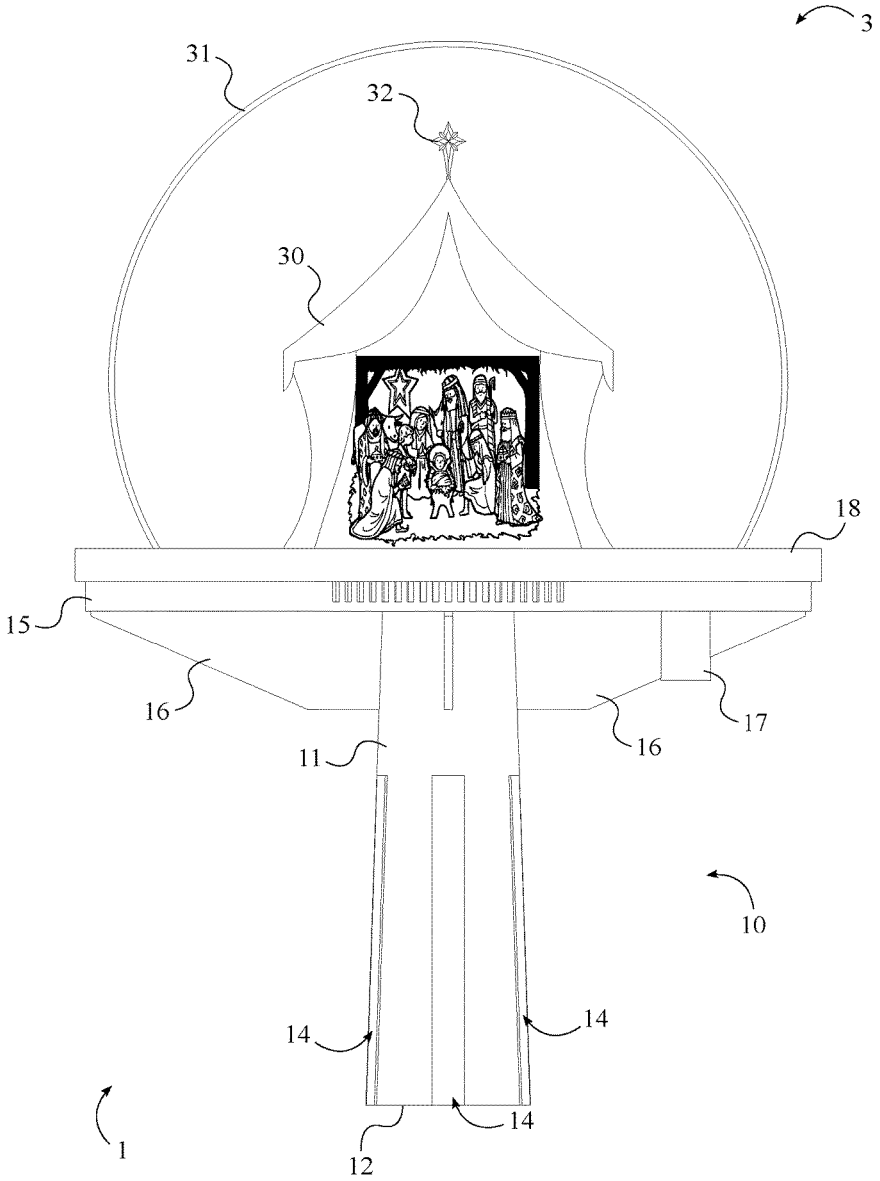
FIG. 11 is a front elevational view, wherein the festive diorama is a nativity scene.

In reference to FIG. 1, the ornamental display 3 is adjacently attached to the rotating platform 18 opposite the support structure 10, wherein the ornamental display 3 is prominently showcased atop the tree, as depicted in FIG. 6, and can be spun via the rotating platform 18. The ornamental display 3 comprises a festive diorama 30, a dome enclosure 31, and a light assembly 32; both the festive diorama 30 and the dome enclosure 31 being adjacently attached to the rotating platform 18. More specifically, the festive diorama 30 and the dome enclosure 31 are removably attached to the rotating platform 18 such that the festive diorama 30 and the dome enclosure 31 can be interchanged with different ornamental designs. The festive diorama 30 is encased by the dome enclosure 31, wherein the dome enclosure 31 protects the festive diorama 30. In the preferred embodiment of the present invention, the festive diorama 30 is a nativity scene as depicted in FIG. 11, however, in other embodiments, the festive diorama 30 may depict any other festive symbol, scene, etc.

The light assembly 32 is utilized to illuminate the festive diorama 30 and the dome enclosure 31. The light assembly 32 comprises one or more lights that are positioned about the festive diorama 30; each of the lights being integrated into the festive diorama 30. Each of the lights may be positioned within an ornamental casing, wherein the ornamental casing is designed to blend into the overall design of the festive diorama 30. For example, if the festive diorama 30 is a nativity scene, the ornamental casing may be designed to depict the Star of Bethlehem. The ornamental casing can also be used to influence the color or intensity of the light emitted from the light positioned within the ornamental casing.

Figure 9:
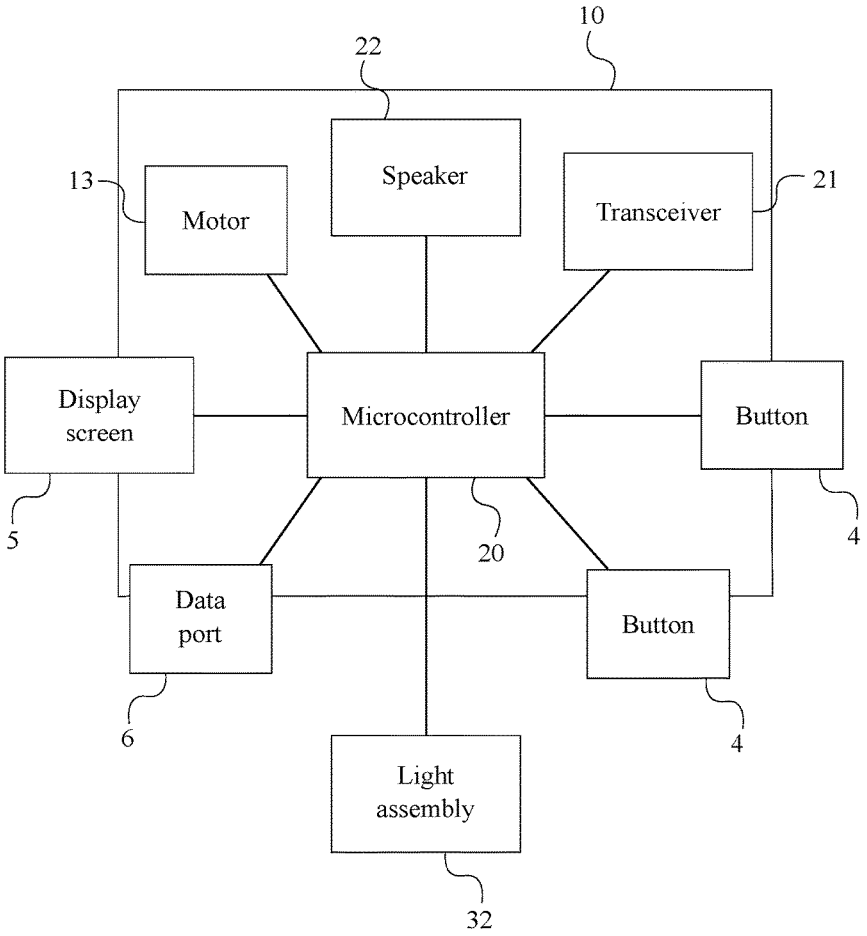
FIG. 9 is a wiring diagram, wherein the microcontroller is operatively coupled to the motor, the speaker, the light assembly, and the plurality of buttons, and electronically connected to the transceiver, the display screen, and the data port.
Figure 10:
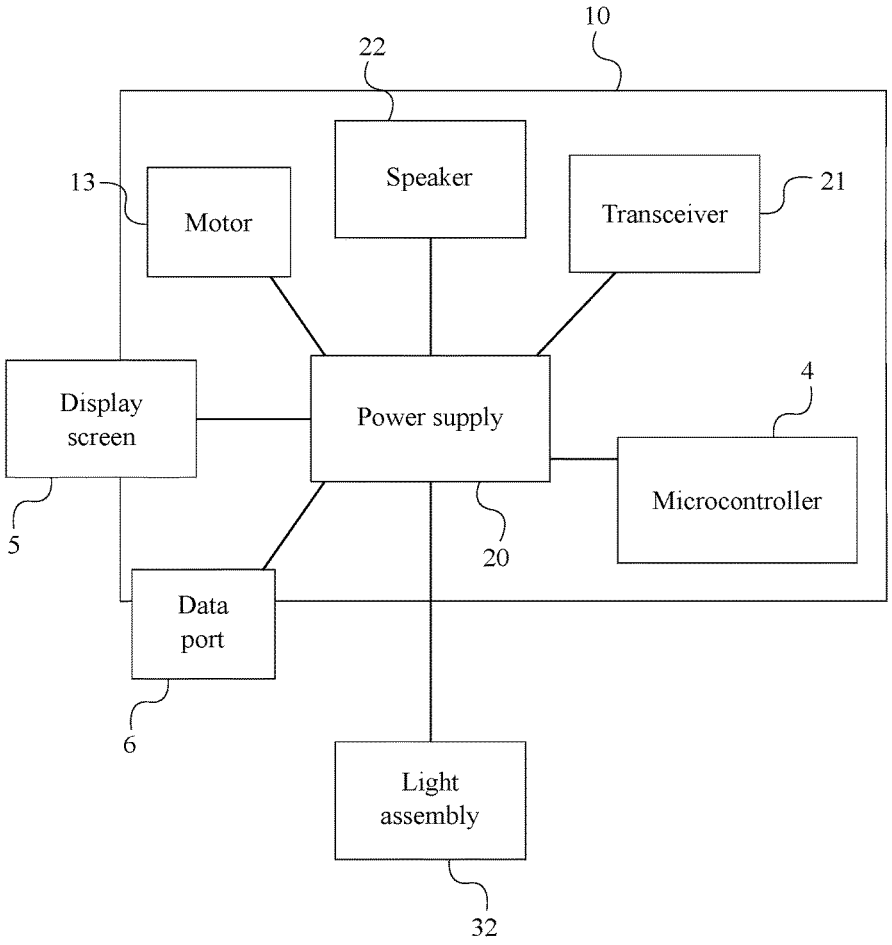
FIG. 10 is an electrical diagram, wherein the power supply is electrically connected to the microcontroller, the motor, the speaker, the transceiver, the display screen, the data port, and the light assembly.

In reference to FIG. 9-10, the electronics assembly 2 is positioned within the ornament support assembly 1, wherein the electronics assembly 2 is used to power and manipulate the light assembly 32 and the motor 13 (and in turn the rotating platform 18 and the ornamental display 3). The electronics assembly 2 comprises a microcontroller 20, a transceiver 21, a speaker 22, and a power supply 23. The microcontroller 20 provides the central processing functions that are required to control other components, while the power supply 23 is utilized to distribute current in order to power other components. The transceiver 21 is utilized by the microcontroller 20 to communicate with external devices; particularly to receive settings commands and audio files to be played via the speaker 22.

In reference to FIG. 10, the power supply 23 is electrically connected to the motor 13, the transceiver 21, the speaker 22, the microcontroller 20, and the light assembly 32, wherein the power supply 23 provides current to power said components. Preferably, the power supply 23 is a battery, either single use or rechargeable, such that no power cords are required. If the power supply 23 is a single use battery, then an access panel is integrated into either the sheath 11 or the support platform 15, such that the power supply 23 can be removed and replaced. If the power supply 23 is a rechargeable battery, then a charging port may be provided in place of the access panel, wherein a power cable is plugged into the charging port in order to recharge the power supply 23. While not ideal, it is also possible for the power supply 23 to be a power cord that is plugged into an outlet.

In reference to FIG. 9, the microcontroller 20 is operatively connected to the motor 13, the speaker 22, and the light assembly 32, wherein the microcontroller 20 is utilized to adjust parameters of said components. More specifically, the microcontroller 20 is utilized to adjust the speed of the motor 13 and thus the speed at which the rotating platform 18 and the ornamental display 3 are rotated; process the audio file that is to be played through the speaker 22; set the volume at which the audio file is played; set the brightness and color of the light assembly 32; and set the interval at which the light assembly 32 projects light (e.g. constant, flashing, patterned). The transceiver 21 is electronically connected to the microcontroller 20, such that the microcontroller 20 can receive commands from an external device for adjusting said parameters.

The microcontroller 20 comprise a processing unit, a non-volatile memory bank, and a control circuit. The control circuit connects the microcontroller 20 to the other components, while the processing unit receives and sends commands, and functions to control the components that are connected to the microcontroller 20 via the control circuit. The non-volatile memory bank is utilized to store commands, command responses, pre-set parameters, audio files, etc., wherein the processing unit is in communication with the non-volatile memory bank to retrieve, store, and process such data.

In the preferred embodiment of the present invention, the external device to which the transceiver 21 is communicably connected is a personal computing device such as a smartphone or laptop. The transceiver 21 can be communicably coupled to the personal computing device using any wireless communication standard. Using a software application installed on the personal computing device, a user can adjust the parameters of the motor 13, the speaker 22, and the light assembly 32, wherein corresponding commands are sent from the personal computing device to the transceiver 21. Furthermore, audio files stored on the personal computing device can be transferred to the microcontroller 20 through the transceiver 21 and stored on the non-volatile memory bank. It may also be possible to stream audio files to the speaker 22 through the transceiver 21, without storing the audio files.

Figure 8:
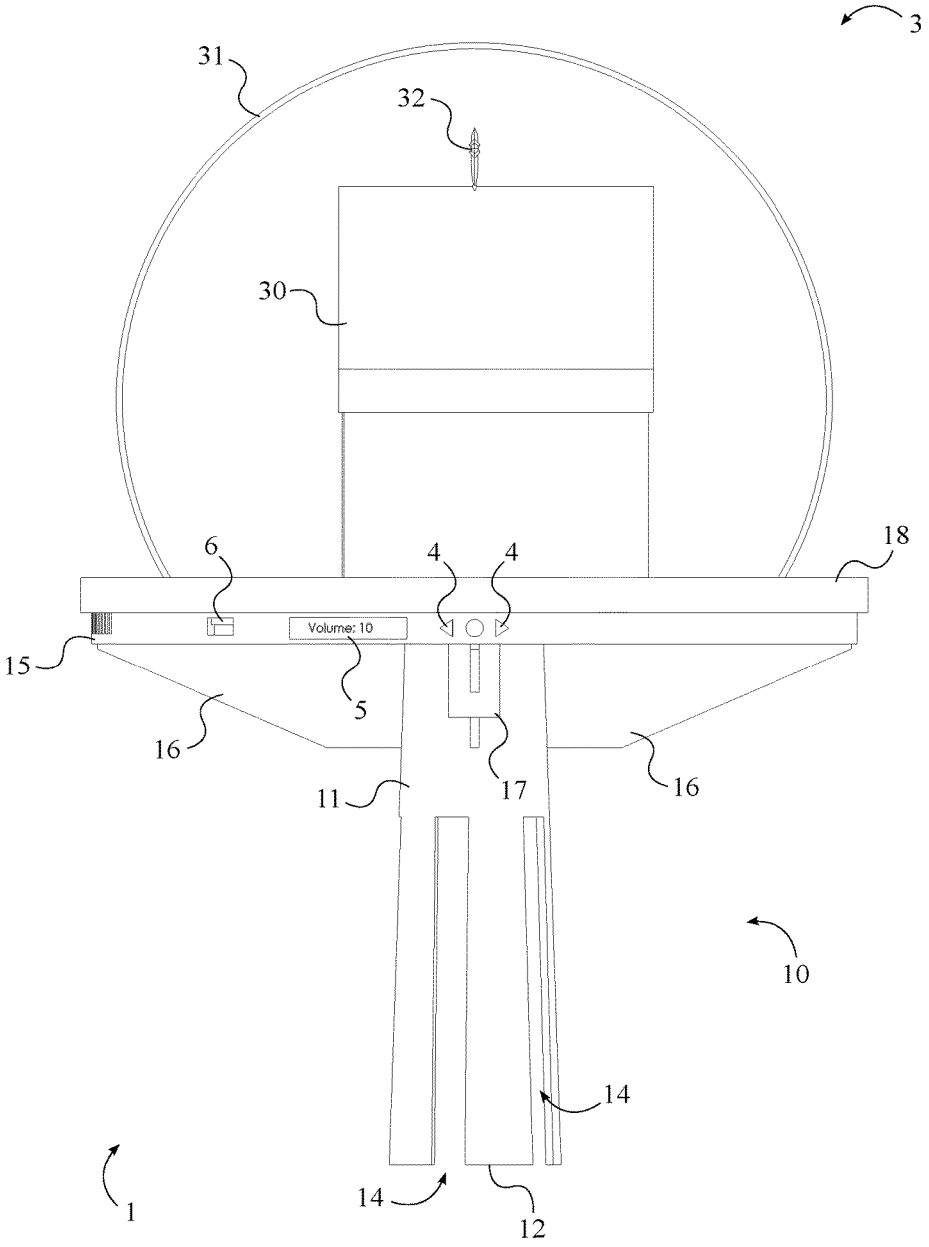
FIG. 8 is a right side elevational view, wherein the plurality of buttons is mounted to the support structure and the display screen and the data port are mounted into the support structure.

In another embodiment, the present invention further comprises a remote controller 8. The remote controller 8 is a dedicated device that is communicably coupled to the transceiver 21. Similar to the software application on the personal computing device, the remote controller 8 is utilized to send commands to the microcontroller 20 via the transceiver 21. The remote controller 8 provides the user with a series of set commands that are preprogrammed and synched with the microcontroller 20. When using the remote controller 8, the present invention may further comprise a data port 6 that is mounted into the support structure 10, as depicted in FIG. 8. The data port 6 is electronically connected to the microcontroller 20 and electrically connected to the power supply 23, as depicted in FIG. 9 and FIG. 10 respectively, wherein the data port 6 allows an external device to be physically wired to the present invention in order to send commands or transfer data, such as audio files, to the microcontroller 20.

In yet other embodiments, the present invention may further comprise a plurality of buttons 4 or a display screen 5. Each of the plurality of buttons 4 is mounted to the support structure 10 as shown in FIG. 8 and operatively connected to the microcontroller 20 as depicted in FIG. 9, wherein the plurality of buttons 4 is utilized to adjust the parameters of the motor 13, the speaker 22, and the light assembly 32. Similarly, the display screen 5 is mounted into the support structure 10 as shown in FIG. 8 and is electronically connected to the microcontroller 20 and electrically connected to the power supply 23 as depicted in FIG. 9 and FIG. 10 respectively. The display screen 5 allows for a visual depiction of the parameters that are being adjusted by the user through the plurality of buttons 4, such as rotation speeds, volume levels, and light levels. It is also possible for the display screen 5 to be a touchscreen, wherein the parameters can be adjusted via interaction with the display screen 5 instead of the plurality of buttons 4.

Figure 4:
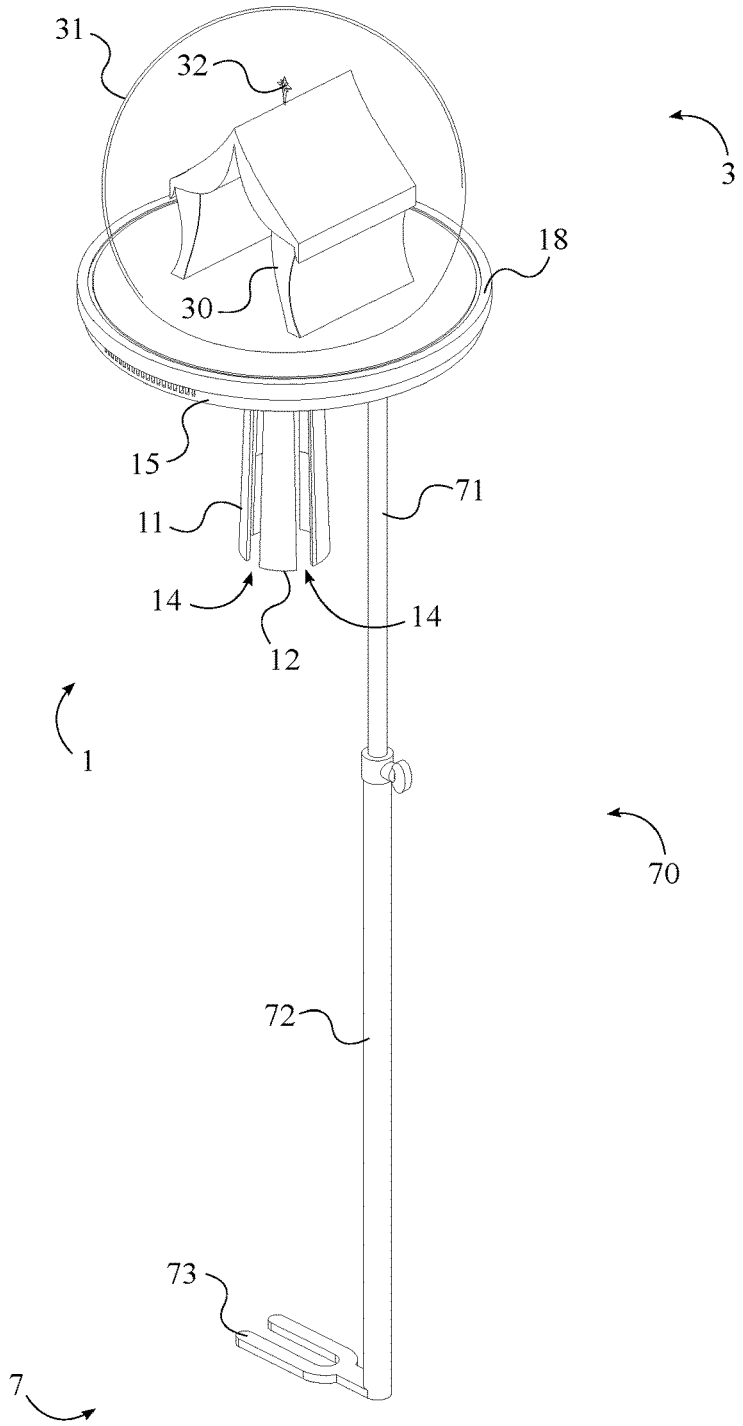
FIG. 4 is a perspective view, wherein the stabilization post is attached to the support structure.
Figure 5:
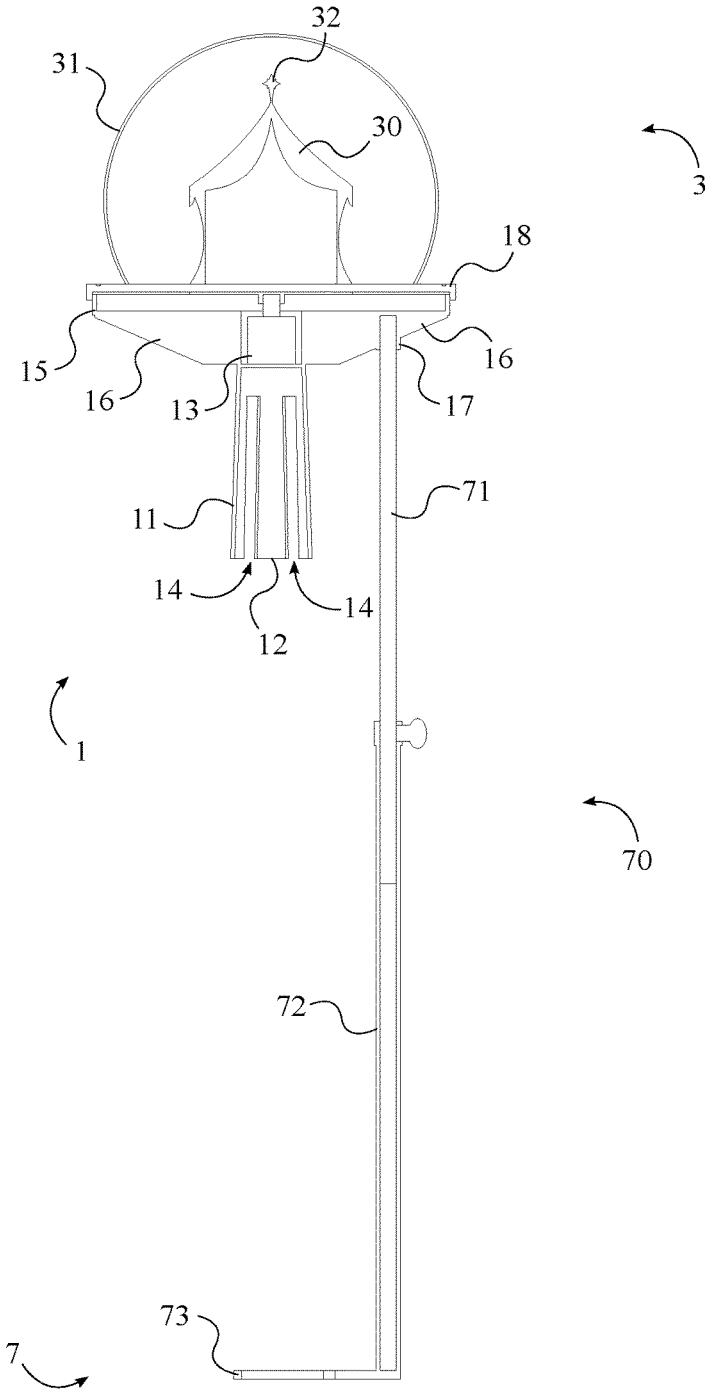
FIG. 5 is a front sectional view, wherein the dowel is slidably positioned into the adjustment sleeve.

In reference to FIG. 4, the stabilization post 7 provides an additional means for bracing the support structure 10 atop the tree. The stabilization post 7 comprises a vertical support 70 and a stirrup base 73; the vertical support 70 being terminally connected to the support structure 10 and the stirrup base 73 being terminally connected to the vertical support 70 opposite the support structure 10. The vertical support 70 is positioned into the seat 17 as depicted in FIG. 5, wherein the seat 17 is adjacently connected to the support platform 15 opposite the rotating platform 18. The seat 17 retains the vertical support 70 in a fixed position relative to the sheath 11 and the support platform 15, wherein the vertical support 70 traverses downwards from the support platform 15, along the length of the tree trunk.

The stirrup base 73 is utilized to attach the stabilization post 7 to the tree trunk or the limb support pole of an artificial tree. The stirrup base 73 is a flange that comprises a first arm and a second arm that are symmetrical with each other. When used with an artificial tree, the stirrup base 73 is positioned onto the limb support pole and positioned around a tree top support; the limb support pole being the main support of the artificial tree and the tree top support being the top portion attached to the terminal end of the limb support pole. The stirrup base 73 rests on the limb support pole, wherein the tree top support is positioned in between the first arm and the second arm.

Figure 7:
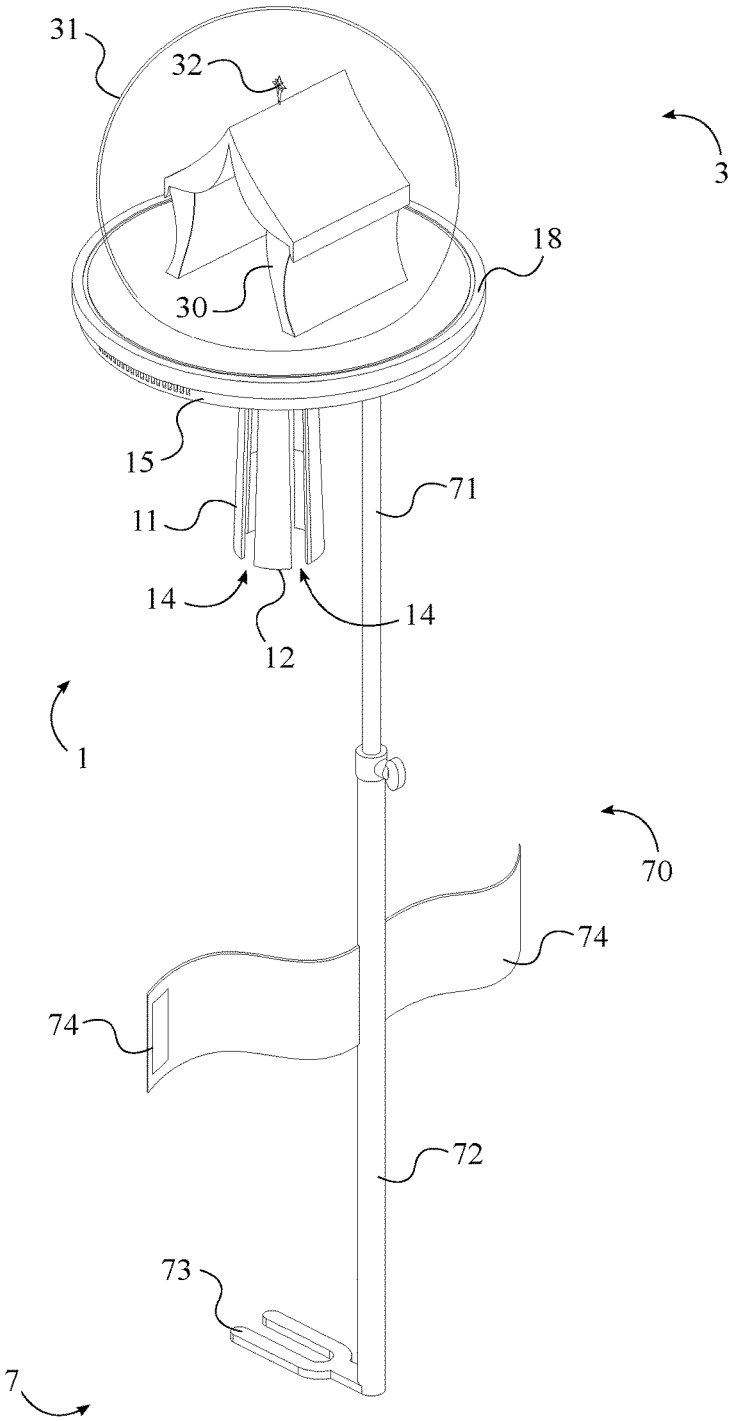
FIG. 7 is a perspective view, wherein the stabilization post further comprises the at least one fastener.

In some embodiments, the first arm and the second arm may be bendable or hinged, such that the first arm and the second arm can be clamped inwards towards each other. In such a way, the first arm and the second arm can be clamped around the tree trunk, the limb support pole, or the tree top support in order to secure the stirrup base 73 in place, preventing any lateral movement. In reference to FIG. 7, in other embodiments, the stabilization post 7 may further comprise an at least one fastener 74. The at least one fastener 74 is adjacently connected to the vertical support 70 in between the support structure 10 and the stirrup base 73, wherein the at least one fastener 74 provides a means for securing the vertical post to the tree trunk, limb support pole, or tree top support. The at least one fastener 74 can be a tie, a hook and loop fastener, or any other similar means of providing a secure connection to prevent lateral movement of the vertical support 70.

In reference to FIG. 4-5, the vertical support 70 comprises a dowel 71 and an adjustment sleeve 72 that are used in tandem to adjust the position of the stirrup base 73 from the support platform 15. The dowel 71 is slidably positioned into the adjustment sleeve 72, wherein the dowel 71 is terminally connected to the support structure 10 and the stirrup base 73 is terminally connected to the adjustment sleeve 72. The adjustment sleeve 72 can be slid up and down along the dowel 71 in order to adjust the height of the stirrup base 73 to the desired location along the tree trunk, limb support pole, or tree top support. A locking mechanism is then utilized to retain the adjustment sleeve 72 in the desired position along the sleeve. In one embodiment, the locking mechanism is a wing bolt that is threaded through the adjustment sleeve 72 and interfaces with the dowel 71, applying pressure to retain the position of the adjustment sleeve 72 along the dowel 71.

In an alternative embodiment of the present invention, the support structure 10 comprises a platform support collar. The platform support collar is used in conjunction with the plurality of braces 16 in lieu of the support platform 15. The platform support collar is positioned around the sheath 11, wherein the platform support collar is able to rotate about the sheath 11. Each of the plurality of braces 16 is terminally connected to the platform support collar and the rotating platform 18. As such, the platform support collar is rotated in tandem with the rotating platform 18, as the rotating platform 18 is driven by the motor 13. The platform support collar and the plurality of braces 16 act to laterally stabilize the rotating platform 18, maintaining a level surface.

In yet another alternative embodiment, the present invention further comprises a base. The base is terminally attached to the sheath 11 about the terminal edge 12, wherein the base provides an anchoring body to retain the position of the ornament support assembly 1 about a surface such as a table. The base is weighted, or otherwise designed to distribute the weight of the ornament support assembly 1, in order to stably retain the ornament support assembly 1 in an upright position. The base can be readily detached from the sheath 11, allowing the ornament support assembly 1 still be placed atop a tree if desired.

Although the invention has been explained in relation to its preferred embodiment, it is to be understood that many other possible modifications and variations can be made without departing from the spirit and scope of the invention as hereinafter claimed.

What is claimed is:

1. A decorative tree ornament comprising: an ornament support assembly comprising a support structure, a rotating platform, and a stabilization post; the support structure comprising a sheath and a motor; an electronics assembly comprising a microcontroller, a transceiver, a speaker and a power supply; the electronics assembly being positioned within the ornament support assembly; the motor being concentrically mounted with the sheath opposite a terminal edge of the sheath; the rotating platform being rotatably connected to the support structure; the rotating platform being terminally connected to the motor opposite the sheath; an ornamental display being adjacently attached to the rotating platform opposite the support structure; the motor and the speaker being operatively connected to the microcontroller; the transceiver being electronically connected to the microcontroller; and the motor, the transceiver, the speaker, and the microcontroller being electrically connected to the power supply; the stabilization post comprising a vertical support and a stirrup base the vertical support being terminally connected to the support structure and the stirrup base being terminally connected to an adjustment sleeve.

2. The decorative tree ornament as claimed in claim 1 further comprising; the support structure further comprising a plurality of slits; each of the plurality of slits laterally traversing through the sheath; and each of the plurality of slits traversing along the sheath from the terminal edge towards the motor.

3. The decorative tree ornament as claimed in claim 1 further comprising: the ornamental display comprising a festive diorama and a dome enclosure; the festive diorama and the dome enclosure being adjacently attached to the rotating platform; and the festive diorama being encased by the dome enclosure.

4. The decorative tree ornament as claimed in claim 1 further comprising: the ornamental display comprising a light assembly; the light assembly being operatively connected to the microcontroller; and the light assembly being electrically connected to the power supply.

5. The decorative tree ornament as claimed in claim 1 further comprising: the support structure further comprising a plurality of braces; each of the plurality of braces being adjacently connected to both the sheath and the support platform; and the plurality of braces being radially positioned around the sheath.

6. The decorative tree ornament as claimed in claim 5 further comprising: a plurality of braces; each of the plurality of braces being adjacently connected to both the sheath and the support platform; and the plurality of braces being radially positioned around the sheath.

7. The decorative ornament as claimed in claim 1, wherein the sheath is tapered towards the rotating platform.

8. The decorative tree ornament as claimed in claim 1 further comprising: a plurality of buttons; the plurality of buttons being mounted to the support structure; and the plurality of buttons being operatively connected to the microcontroller.

9. The decorative tree ornament as claimed in claim 1 further comprising: a display screen; the display screen being mounted into the support structure the display screen being electronically connected to the microcontroller and the display screen being electrically connected to the power supply.

10. The decorative tree ornament as claimed in claim 9, wherein the display screen is a touchscreen.

11. The decorative tree ornament as claimed in claim 1 further comprising: a data port; the data port being mounted into the support structure; the data port being electronically connected to the microcontroller; and the data port being electrically connected to the power supply.

12. The decorative tree ornament as claimed in claim 1 comprises:

a stabilization post;

the stabilization post comprising a vertical support and a stirrup base;

the vertical support being terminally connected to the support structure;

and the stirrup base being terminally connected to the vertical support opposite the support structure.

13. The decorative tree ornament as claimed in claim 1 further comprising; the vertical support comprising a dowel and an adjustment sleeve; the dowel being slidably positioned into the adjustment sleeve; the dowel being terminally connected to the support structure; and the stirrup base being terminally connected to the adjustment sleeve.

14. The decorative tree ornament as claimed in claim 1 further comprising: the stabilization post further comprising an at least one fastener; and the at least one fastener being adjacently connected to the vertical support in between the support structure and the stirrup base.

15. The decorative tree ornament as claimed in claim 1 further comprising: the support structure further comprising a support platform and a seat; the seat being adjacently connected to the support platform opposite the rotating platform; and the vertical support being positioned into the seat.

* * * * *